US008464921B2

(12) United States Patent
Shima et al.

(10) Patent No.: US 8,464,921 B2
(45) Date of Patent: Jun. 18, 2013

(54) FASTENER DRIVING TOOL

(75) Inventors: Yukihiro Shima, Ibaraki (JP); Hideyuki Tanimoto, Ibaraki (JP); Takashi Ueda, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 670 days.

(21) Appl. No.: 12/365,456

(22) Filed: Feb. 4, 2009

(65) Prior Publication Data

US 2009/0194574 A1 Aug. 6, 2009

(30) Foreign Application Priority Data

Feb. 5, 2008 (JP) ..... 2008-024832

(51) Int. Cl.
*B25C 1/06* (2006.01)

(52) U.S. Cl.
USPC ..... 227/131; 227/8

(58) Field of Classification Search
USPC ..... 227/2, 8, 131, 134
See application file for complete search history.

(56) References Cited

U.S. PATENT DOCUMENTS

| | | | | |
|---|---|---|---|---|
| 4,161,272 | A * | 7/1979 | Brockl | 227/131 |
| 5,320,270 | A * | 6/1994 | Crutcher | 227/131 |
| 5,605,268 | A * | 2/1997 | Hayashi et al. | 227/8 |
| 6,744,318 | B2 * | 6/2004 | Yokoyama et al. | 330/251 |
| 2006/0087286 | A1 * | 4/2006 | Phillips et al. | 320/114 |

* cited by examiner

*Primary Examiner* — M. Alexandra Elve
*Assistant Examiner* — Nathaniel Chukwurah
(74) *Attorney, Agent, or Firm* — McDermott Will & Emery LLP

(57) ABSTRACT

A controller controls a first FET to go on and off based on an input signal of a trigger switch and a push switch and controls a second FET to go on and off based on an input signal of a trigger switch, a push switch, and a operation detection switch. The controller then controls the time that the first FET is on for to be longer than the time the second FET is on for.

10 Claims, 14 Drawing Sheets

ROTATE THROUGH 135 DEGREES

ROTATE THROUGH 270 DEGREES

REVERSE ROTATED STATE

TIME
t0
t1
t2
t3
t4
t5
t6

TRIGGER SWITCH
ON
OFF

PUSH SWITCH
ON
OFF

FIRST FET
ON
OFF
T2
Th

SECOND FET
ON
OFF
T1

DRUM ROTATION ANGLE
360°
180°
0°
200°
200°

DRIVE DETECTION SWITCH
ON
OFF

OPERATION DETECTION SWITCH
ON
OFF
UPPER DEAD POINT (Pm)

PLUNGER POSITION
(Pm/2)
Ph
Ph
LOWER DEAD POINT (0)

TIME
t10
t11
t12
t13
t14
t15
t16

TRIGGER SWITCH
ON
OFF

PUSH SWITCH
ON
OFF

FIRST FET
ON
OFF
Th
T2

SECOND FET
ON
OFF
T1
360°

DRUM ROTATION ANGLE
80°
200°
200°
0°

DRIVE DETECTION SWITCH
ON
OFF

OPERATION DETECTION SWITCH
ON
OFF
UPPER DEAD POINT (Pm)

PLUNGER POSITION
(Pm/2)
Ph
Ph
LOWER DEAD POINT (0)

FASTENER DRIVING TOOL

BACKGROUND OF THE INVENTION

1. Field of the Invention

The present invention relates to a fastener driving tool for fastening a fastener such as a nail, rivet, or staple to a member to be fastened.

2. Description of the Related Art

In the related art, spring-driven type fastener driving tools employing electric motors are well-known. This type of spring-driven type fastener driving tool uses the drive power of an electric motor to push up a plunger urged by a spring in a direction from a lower dead point in a fastening direction to an upper dead point in resistance to urging force of the spring. A fastener such as a nail is then driven into a member to be fastened by an accelerated plunger as a result of the plunger being released.

Typically, nail driving equipment is equipped with a mode switching switch for selecting one operating mode of a single driving mode or a continuous driving mode. For example, when the mode switching switch is in single driving mode, the operator presses a push lever (push switch) provided at a nose section that emits nails against a member to be fastened. In this state, the operator fires one nail by pulling a trigger of the trigger switch. It is then not possible for the next mail to be driven in until the operator temporarily releases operation of both the push switch and the trigger switch. When the operator selects continuous driving in mode, the operator can drive in a nail every time the push-switch is pressed against the member to be fastened while the trigger of the trigger switch is pulled in by the operator.

However, recently, it has been necessary for the force with which the plunger is urged by the drive spring to be increased in spring-driven-type fastener driving tools, i.e. the spring energy has been increased in order to increase the drive impact force to make it possible to drive in larger nails. However, when the spring energy is made large, the spring driven-type fastener driving tool has to move the plunger from the lower dead point side to the upper dead point side using the drive power of the electric motor in resistance to a substantial urging force of the spring. This means that a large amount of time is required to move the plunger for the drive in operation. This means that when the operator drives in the nails into the member to be fastened in continuous drive in mode while continuing to pull the trigger switch, a substantial time difference (time lag) occurs from the operation of the trigger switch until the end of the operation of driving nails. The feeling when driving in is therefore poor, and a problem where the driving efficiency is reduced occurs.

On the other hand, in order to ensure the reliability of the fastener driving tool, when the nose section is drawn away from the member to be fastened, it is preferable for the driving of the electric motor to be stopped by the push switch so that an inappropriate driving operation is actively prevented. There are also cases where a continuous driving mode is required in order to increase the ease of use of the fastener driving tool. In particular, in continuous driving mode, when the operator withdraws the push lever of the nose section away from the member to be fastened to quickly, a problem occurs where sufficient operation time for the electric motor cannot be ensured and spring compression due to the spring compression drive unit becomes insufficient. Namely, after the end of driving in the nail as a result of releasing the compressed spring, it is necessary to compress the driving spring back to its initial state using the motor. However, it is not possible for operating time of the motor to be sufficiently ensured by the fast release of the push switch.

In order to resolve the above problems, it is an object of the present invention to provide a highly reliable spring drive-type fastener driving tool that responds without differences with respect to the operation of operation switches such as trigger switches and push switches etc. and is capable of improving the feeling when driving.

SUMMARY OF THE INVENTION

In order to achieve the above object, a fastener driving tool of a first aspect of the invention comprises:

a motor;

a magazine that supplies fasteners to a nose;

a plunger, arranged between an upper dead point and a lower dead point so as to be capable of moving up and down, having a blade for driving in the fasteners supplied to the nose;

a drive spring that urges the plunger downwards, arranged so as to be compressible upwards;

a spring compression drive unit that moves the plunger in a direction of compression of the drive spring based on the driving power of the motor;

a first operation switch that detects a first user operation;

a second operation switch that detects a second user operation;

an operation detection switch that detects operation of the spring compression drive unit;

a first switching element and a second switching element individually controlled to go on or off, electrically connected in series, and making supply of electrical power to the motor possible when both the first switching element and the second switching element are on; and a controller that controls the first switching element to go on or off based on an output from the first operation switch and the second operation switch and that controls the second switching element to go on or off based on an output from the first operation switch, the second operation switch, and/or the operation detection switch.

The controller:

puts the first switching element on when the first operation switch detects the first user operation and the second operation switch detects the second user operation; and puts the first switching element off after keeping the first switching element on for a prescribed time when the first operation switch or the second operation switch no longer detects the first user operation or the second user operation when the first switching element is on.

The controller also:

puts the second switching element on when the first operation switch detects the first user operation and the second operation switch detects the second user operation, and puts the second switching element off when the operation detection switch detects a prescribed operation of the spring compression drive unit.

Further, the controller:

sets the prescribed time so that the time that the first switching element is on for is longer than the time that the second switching element is on for.

The controller:

puts the second switching element off when the operation detection switch detects that the drive spring of the plunger is moved to a prescribed position in a direction of compression by the spring compression drive unit.

The prescribed time is regulated so as to correspond to a time for the spring compression drive unit to move the plunger to the prescribed position.

The controller defines the prescribed time within a range of 100 milliseconds to 500 milliseconds.

The controller comprises:

a first control system circuit that controls the first switching element to go on or off based on an input signal corresponding to an operation of the first operation switch or the second operation switch, and a second control system circuit that controls the second switching element to go on or off based on an input signal corresponding to an operation of the first operation switch and the second operation switch and a detection signal of the operation detection switch.

The first control system circuit:

puts the first switching element on when the first operation switch detects the first user operation and the second operation switch detects the second user operation, and puts the first switching element off after keeping the first switching element on for a prescribed time when the first operation switch or the second operation switch no longer detects the first user operation or the second user operation when the first switching element is on.

The first control system circuit keeps the first switching element on for the prescribed time even after the first operation switch or the second operation switch no longer detects the first user operation or the second user operation by delaying the input signal corresponding to an operation of the first operation switch and/or the second operation switch.

The first switching element and the second switching element respectively are field effect transistors.

The spring compression drive unit has a rotating body that rotates in a prescribed direction of rotation based on the drive power of the motor, and moves the plunger in a direction of compressing the drive spring by winding in a hoisting connecting line connected to the plunger using rotation of the rotating body in the prescribed rotation direction.

The operation detection switch detects a position of rotation of the rotating body.

The first operation switch is a trigger switch that detects an operation of pulling of the trigger pulled-in when the user performs a fastener driving in operation.

The second operation switch is a push switch that detects an operation where the user brings the nose into contact with a member to be fastened.

The controller supplies electrical power to the motor for a first time duration where the first switching element and the second switching element are both on by putting the second switching element on for the first time duration based on a signal from the trigger switch, the push switch, and/or the operation detection switch and putting the first switching element on for a second time longer than the first time duration based on a signal from the trigger switch and the push switch.

The spring compression drive unit comprises:

a rotating body that rotates in a prescribed rotation direction based on the drive power of the motor.

Within the first time duration, after the drive spring is compressed upwards by rotating the rotating body in the prescribed rotation direction, the compressed drive spring is released and extended downwards by disengaging the transmission of the drive power of the motor to the rotating body, and the drive spring is compressed upwards until the plunger moves upwards to the prescribed position as a result of the rotating body again rotating in the prescribed rotation direction.

According to fastener driving tool of the present invention, it is possible to improve the driving in feeling while responding with no time difference with respect to the operation of an operation switch such as a trigger switch or a push switch.

Other objects and characteristics of the present invention will become clear from the following explanation of the specification and the appended drawings.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

Figure 1:
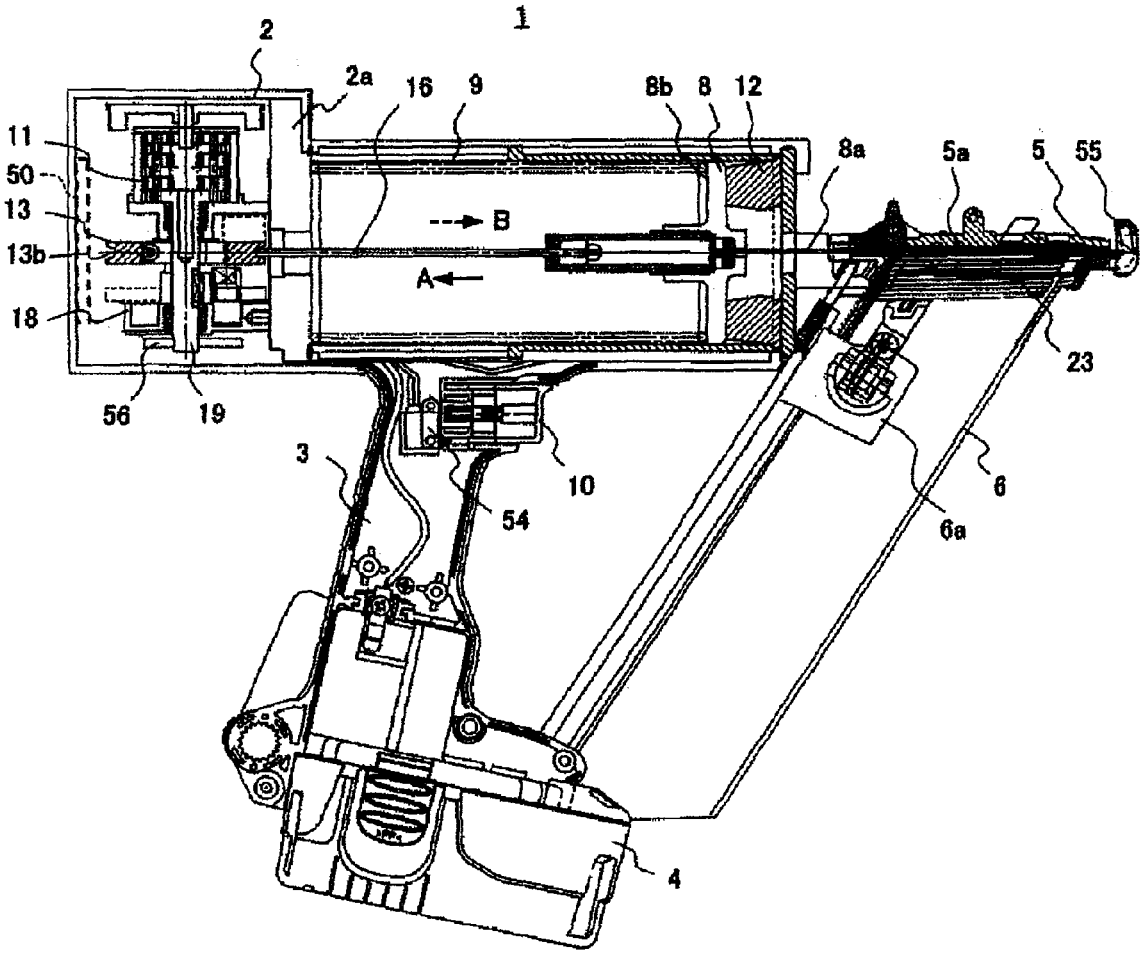
FIG. 1 is a side view including a partial cross-section of a fastener driving tool of an embodiment of the present invention.
Figure 2:
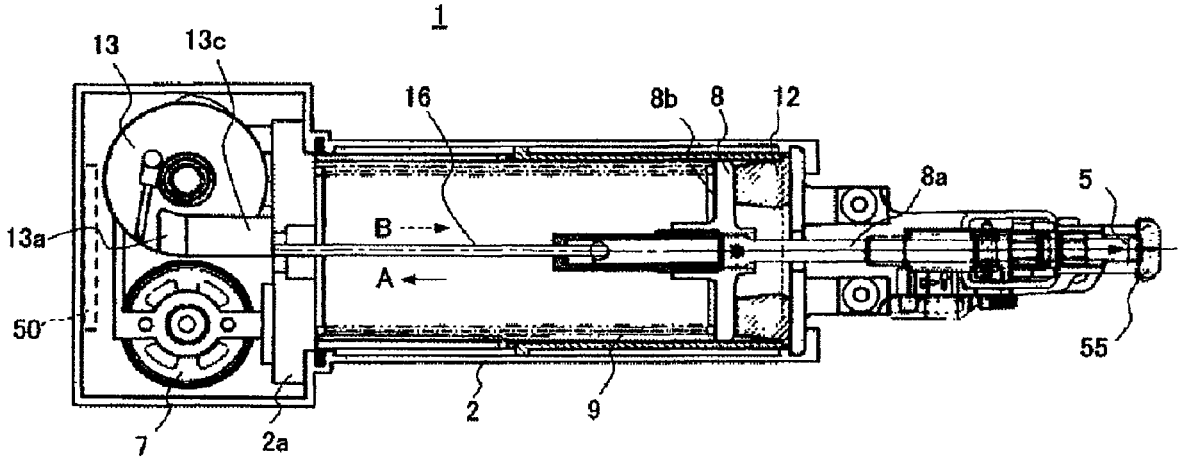
FIG. 2 is a plan view including a partial cross-section of the fastener driving tool shown in FIG. 1.

The following is an explanation with reference to the drawings of a spring-driven fastener driving tool of the embodiment of the present invention. In all of the drawings illustrating the embodiment, portions having the same function are given the same numerals and are not repeatedly described. In the following explanation of the fastener driving tool of the present invention, for convenience, the direction in which the fastener is driven is referred to as "downwards" and the opposite direction to this direction is referred to as "upwards". This is in no way limiting with regards to special embodiments or intentions of the present invention and the present invention is by no means limited to either direction of driving the fastener.

[Regarding the Assembly Configuration for the Fastener Driving Tool]

FIGS. 1 to 12 show structural views and circuit diagrams for a fastener driving tool of the embodiment. First, a description is given of the overall structure of the fastener driving tool with reference to FIGS. 1 to 3.

A fastener driving tool 1 includes a fuselage housing unit 2, a handle housing unit 3, a battery pack (storage battery) 4, a nose (ejection section) 5, and a magazine 6. The handle housing unit 3 extends so as to branch off from the fuselage housing unit 2. The battery pack 4 is detachably installed at an end of the handle housing unit 3 and is electrically connected to an electric motor 7 (refer to FIGS. 2 and 3). The nose 5 is provided at the tip (lower end) in a fastener driving direction of the fuselage housing unit 2. The magazine 6 is loaded with nails 23 constituting fasteners that are connected together and supplies the nails 23 one at a time to within an ejection section path 5*a* of the nose 5.

Figure 3:
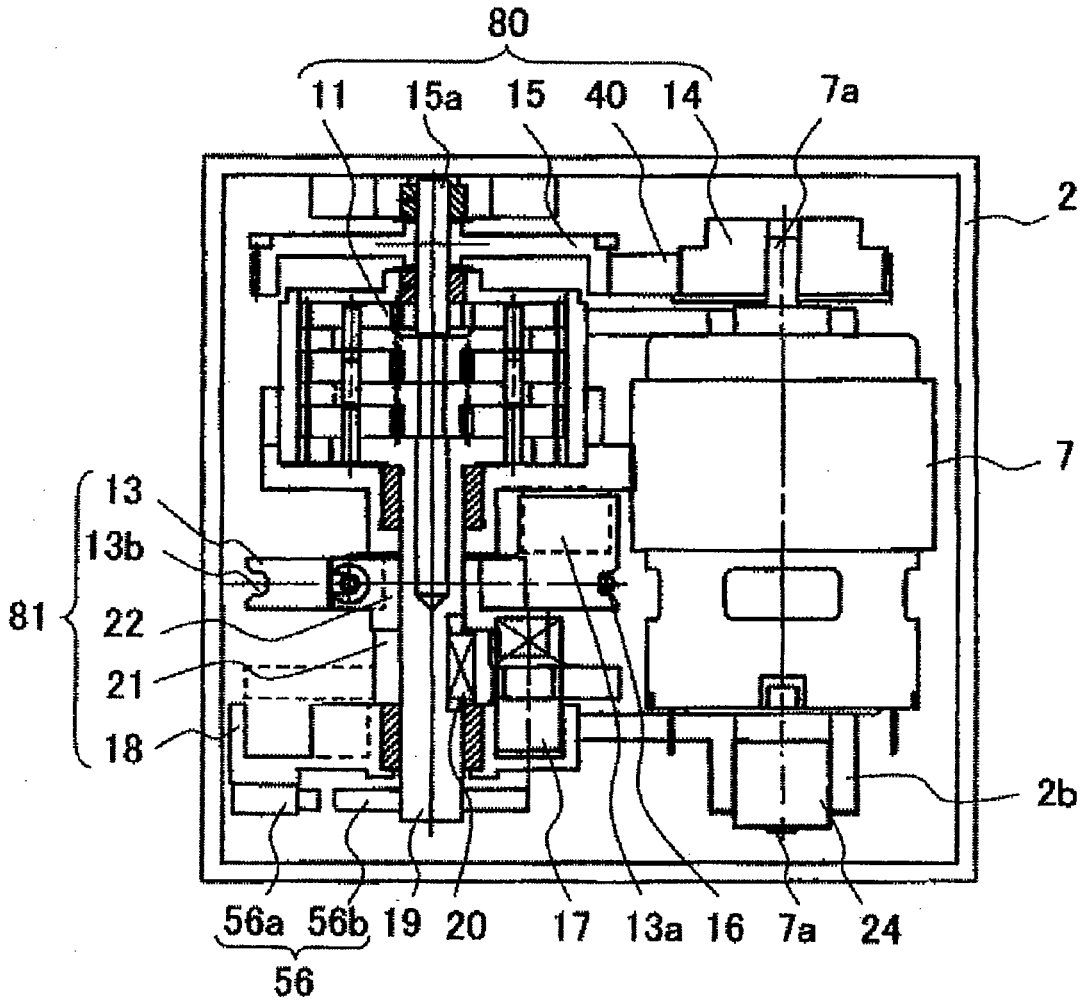
FIG. 3 is a rear view including a partial cross-section of the fastener driving tool shown in FIG. 1.

A plunger 8, a drive spring (coil spring) 9, the motor 7, a reduction mechanism unit 80 (refer to FIG. 3), a spring compression release mechanism unit 81 (simply referred to as "spring compression drive unit" in the following) (refer to FIG. 3), and a controller (control circuit device) 50 (refer to FIG. 11) are built into the fuselage housing unit 2. The drive spring 9 provides striking power (firing power) to the plunger 8 and the reduction mechanism unit 80 reduces the rotation of the motor 7 and outputs a large torque. The spring compression drive unit 81 both compresses and releases the drive spring 9. As described in the following, the spring compression drive unit 81 includes a wire or rope (hoisting connecting line) 16, a drum (rotating body) 13, a drum hook 22, a pin support plate 21, a power transmission pin 17, and a guide plate 18. As shown in FIG. 3, an operation detection switch 56 is fitted to a rotation output shaft 19. The operation detection switch 56 detects the rotation angle of the rotation output shaft 19 (drum 13) of the reduction mechanism unit 80. The operation detection switch 56 is constituted by a microswitch including a switch unit 56*a* fixed to the guide plate 18 (fuselage housing unit 2) and a rotating pressing section (cam section) 56*b* located at the rotation output shaft 19 that causes the switch unit 56*a* to go on or off at a prescribed rotation angle of the rotation output shaft 19. A detection signal for whether the operation detection switch 56 is on or off is inputted to the controller 50 (refer to FIG. 11) and is used to control stopping of the motor 7.

As shown in FIG. 1, the handle housing unit 3 takes a side of the fuselage housing unit 2 as a base and extends from the outer periphery of the fuselage housing unit 2. A trigger switch 54 having a trigger 10 operated by the operator/user is provided at the base. The trigger switch 54 is electrically connected to the motor 7 (refer to FIG. 2) and the controller 50 and controls driving of the motor 7. The battery pack 4 is installed at an end of the handle housing unit 3. The battery pack 4 then supplies electrical power to the motor 7 and the controller 50 via the wiring arranged within the handle housing unit 3.

As shown in FIG. 1, the magazine 6 can be provided so as to have one end positioned at the nose 5 and another end positioned at the handle housing unit 3. A large number of nails 23 that are the fasteners are loaded one next to another within the magazine 6 in the direction of extension of the magazine 6. The connected nails 23 are then pressed to the side of the nose 5 by a feeding member 6*a* so that the end of the nail 23 is positioned within the ejection section path 5*a* of the nose 5. This means that the nail 23 positioned within the ejection section path 5*a* is then struck by the tip of a blade 8*a* when the tip of the blade 8*a* moves within the ejection section path 5*a* of the nose 5. The nail 23 is then pushed out from the ejection section path 5*a* of the nose 5 so as to be driven into the member to be fastened (not shown). The struck nail is then accelerated by the plunger 8 (blade 8*a*) up to making contact with the member to be fastened as a result of making the length of the ejection section path 5*a* of the nose 5 longer than the length of the driven nail. The nail 23 is therefore struck firmly as a result. A push switch (push lever) 55 can be provided at the tip of the nose 5. The push switch 55 then detects that the tip of the nose 5 is substantially in contact with the member to be fastened. At the controller 50 (refer to FIG. 11), the push switch 55 functions as an operation switch that controls driving of the motor together with the trigger switch 54 that detects operation of the trigger 10 and inputs a control signal that is off or on to the controller 50.

As shown in FIG. 1, the plunger 8 is arranged so as to be capable of being moved up and down (vertically) both upwards (the direction of arrow A) or downwards (the direction of arrow B) between an upper dead point side and a lower dead point side within the fuselage housing unit 2. The plunger 8 has a blade (driver bit) 8*a*. When the plunger 8 moves to the side of the lower dead point (direction B), the tip of the blade 8*a* extends to as far as the tip of the ejection section path 5*a* defined within the nose 5 that the nail 23 is loaded into. The drive spring 9 is then installed in a compressed state between an upper surface section of a plunger plate 8*b* of the plunger 8 on the upper dead point side and a wall section 2*a* encompassing the spring compression drive unit 81 described later. The spring 9 is then compressed when the plunger 8 is wound to the side of the upper dead point as a result of the wire 16 being wound up by the spring compression drive unit 81. This means that the plunger 8 is pushed by a stronger urging force in a direction towards the lower dead point direction (driving direction) B.

As shown in FIG. 3, the reduction mechanism unit 80 is connected to the motor 7. The reduction mechanism unit 80 includes a first pulley 14 fitted to a rotation output shaft 7*a* of the motor 7, a belt 40, a second pulley 15, and a planetary gear unit 11. The first pulley 14 and the second pulley 15 constitute a first reduction unit that reduces the rotation of the rotation output shaft 7*a* of the motor 7 using the rotation of a rotation output shaft 15*a* of the second pulley 15. The planetary gear unit 11 includes a three-stage planetary gear unit connected to the rotation output shaft 15*a* of the second pulley 15. The planetary gear unit 11 constitutes a second reduction unit that reduces rotation of the rotation output shaft 15*a* of the second pulley 15 using rotation of the rotation output shaft 19 of the planetary gear unit 11. As described in the following, the drum 13 is driven by a rotation force obtained through reduction at the rotation output shaft 19 of the planetary gear unit 11 unit (second reduction unit). The drum 13 winds up the wire 16 so as to move the plunger 8 in the upper dead point direction. The reduction mechanism unit 80 reduces the rotation occurring at the rotation output shaft 7*a* of the motor 7 and transmits the rotation to the rotation output shaft 19 of the drum 13. The torque (rotational power) of the motor 7 is therefore amplified at the rotation output shaft 19 of the drum 13 as a result of this reduction. The compression mechanism for the spring 9 can therefore be applied to a small type motor taken as the motor 7. For example, a reduction ratio between the rotation output shaft 7*a* of the motor 7 and the rotation output shaft 19 (rotation output shaft 19 of the reduction mechanism unit 80) of the drum 13 is 150 to 300.

As shown in FIG. 3, a one-way clutch (reverse rotation prevention mechanism) 24 is provided at the other end of the rotation output shaft 7*a* of the motor 7. The one-way clutch 24 can then be fixed to a fitting unit 2*b* of the fuselage housing unit 2. As described in the following, the one-way clutch 24 then permits the motor 7 (the drum 13) to rotate only in the forward rotation direction (direction A) and prevents the motor 7 from rotating in the opposite direction of rotation (direction B). Namely, when a torque that causes the drum 13 to rotate in an opposite direction B to the direction A that winds up the wire 16 is applied to the rotation output shaft 7*a* of the motor 7, such reverse rotation torque is overcome and rotation in the opposite direction B is prevented. When rotation torque for a forward direction A other than the loss torque is applied to the one-way clutch 24, the one-way clutch 24 permits rotation (idling) in the forward direction A of the motor 7. A roller-type (roller type) clutch or a ratchet type clutch can also be applied as the one-way clutch 24.

[Configuration for Assembling the Spring Compression Drive Unit 81]

Figure 4:
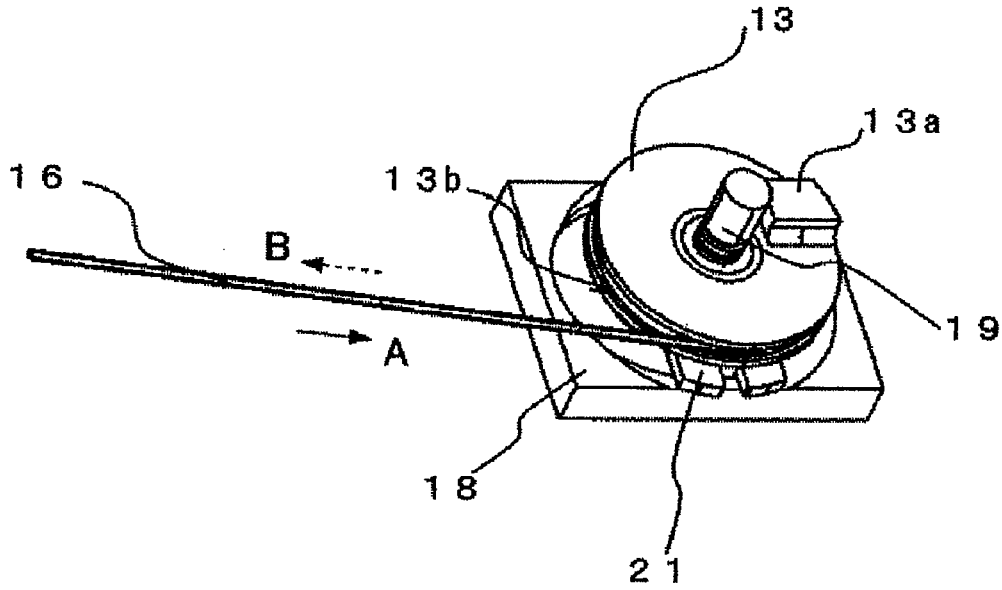
FIG. 4 is a perspective view of a spring compression drive unit constituting the fastener driving tool shown in FIG. 3.
Figure 5:
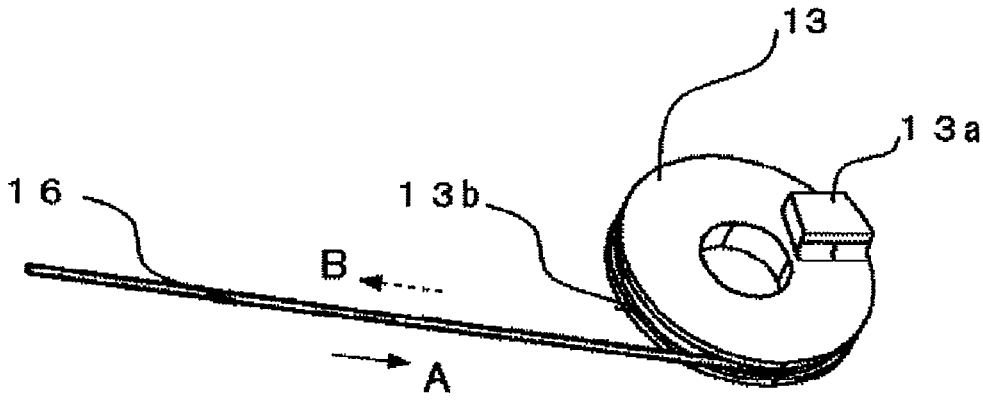
FIG. 5 is a partially enlarged perspective view of the spring compression drive unit shown in FIG. 4.
Figure 5:
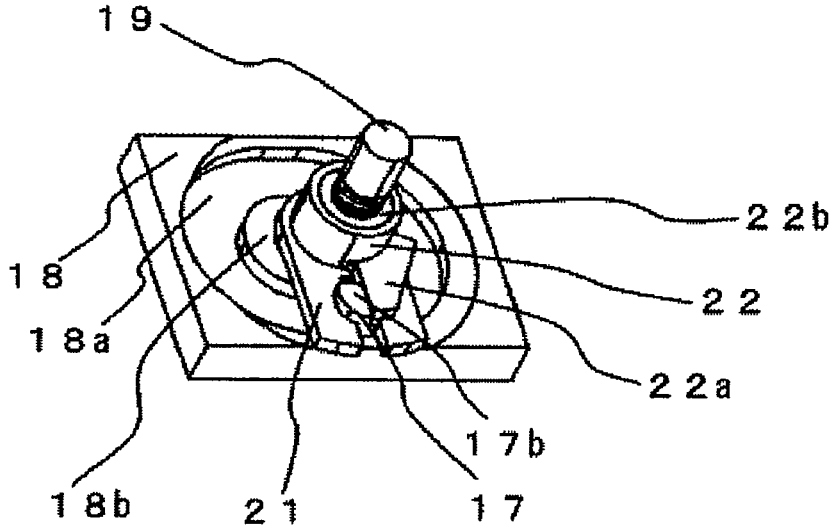
Figure 6:
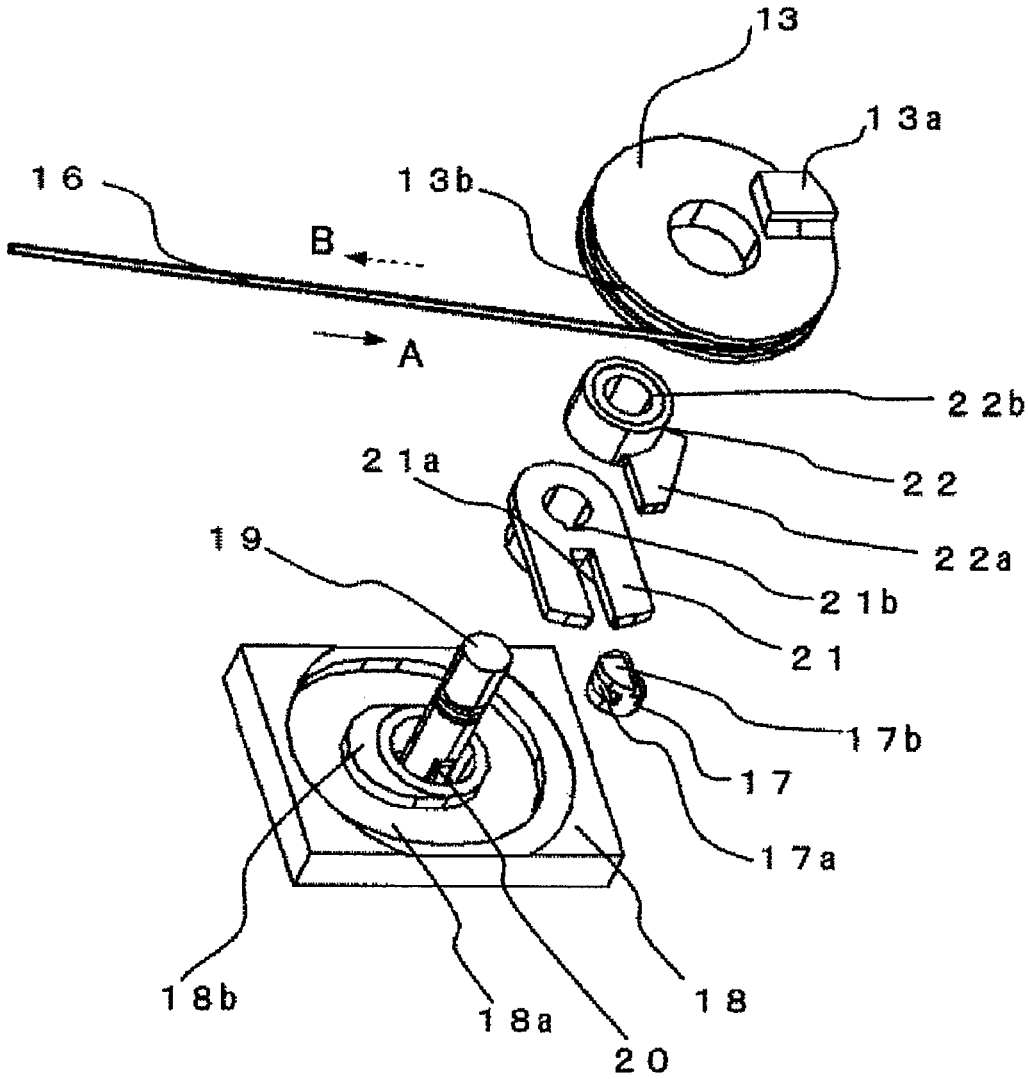
FIG. 6 is a partially enlarged perspective view of the whole of the spring compression drive unit shown in FIG. 4.

As shown in FIGS. 4 to 6, the spring compression drive unit 81 for compressing and releasing the spring 9 includes the guide plate 18 that supports one end of the rotation output shaft 19 of the planetary gear unit 11, the pin support plate 21, the drum hook 22, the drum 13, the power transmission pin 17 slidably supported at the pin support plate 21, and the wire 16 connecting the drum 13 and the plunger 8.

The spring compression drive unit 81 can also cause the drum 13 to rotate in the prescribed direction A from a reference state (rotation angle zero degrees) to a prescribed rotation angle (for example, 270 degrees) using the drive force of the motor 7. The drum 13 then winds up the wire 16 while rotating so as to move the plunger 8. This means that the spring compression drive unit 81 therefore compresses the drive spring 9. When the drum 13 reaches a prescribed rotation angle of 270 degrees, the spring compression drive unit 81 disengages the engagement of the rotation output shaft 19 of the reduction mechanism unit 80 and the rotating shaft of the drum 13. As a result, the drum 13 is supported in a freely rotating manner with respect to the rotation output shaft 19 and rotation in the reverse rotation direction B is therefore possible. When the drum 13 is supported in a freely rotating manner, the drum 13 rotates in the reverse rotation direction B as a result of the urging force of the spring 9. Further, the compressed spring 9 is then rapidly released and the blade 8*a* of the plunger 8 strikes the nail 23 due to the spring energy. Namely, the spring compression drive unit 81 has a function that transmits the motor drive power obtained at the rotation output shaft 19 of the reduction mechanism unit 80 to the drum 13 and compresses the spring 9, and a function that disengages the transmission of the motor drive power to the drum 13 and releases the compressed spring 9.

A detailed description is now given of the spring compression drive unit 81 with reference to FIGS. 4 to 6. The wire 16 used as a winding up connecting line is constructed, for example, by binding a plurality of metal wiring material so as to combine both flexibility and strength. The surface of the wire 16 is coated with resin so as to prevent wear at a drum groove (trough) 13*b* making contact with the wire 16. The outer peripheral section of the cylindrical section of the drum hook 22 is press-fitted into a center hole of the drum 13 and the drum hook 22 and the drum 13 are formed integrally. A bearing (for example, a ball bearing) 22*b* is press-fitted at an inner peripheral surface of the cylindrical section of the drum hook 22 and the bearing 22*b* is installed at the rotation output shaft 19. This means that the drum 13 and the drum hook 22 both become integral and are supported so as to be rotatable with respect to the rotation output shaft 19.

The power transmission pin 17 has a pin slide section (groove section) 17*a* that engages with the pin support plate 21 and a pin hooking section 17*b* that engages with a hook section 22*a* of the drum hook 22. The pin slide section 17*a* engages with a pin support slide section 21*a* in the possession of the pin support plate 21 so as to be slidable. The power transmission pin 17 is arranged so that its side end surface makes contact with a wall section within a guide channel 18*a* of the guide plate 18. The direction and extent of movement of the power transmission pin 17 is controlled by the plane shape of the guide channel 18*a*. The pin hooking section 17*b* that is the other end surface of the power transmission pin 17 is installed at the same height as the height of the hook section 22*a* in the axial direction of the rotation output shaft 19. The pin hooking section 17*b* engages with the hook section 22*a* when the power transmission pin 17 rotates in synchronization with the pin support plate 21. The pin support plate 21 has a key groove 21*b*, with a key 20 provided at the rotation output shaft 19 engaging with the key groove 21*b*. The rotation output shaft 19, the pin support plate 21, and the power transmission pin 17 are therefore configured so as to always rotate in synchronization with each other.

[Operation of the Spring Compression Drive Unit 81]

FIGS. 7 to 10 show the state of rotation of the drum 13 when the spring compression drive unit 81 is in operation. For the convenience of description, the drum 13 coupled to the drum hook 22 by press fitting is shown in a removed state in FIGS. 7 to 10.

Figure 7:
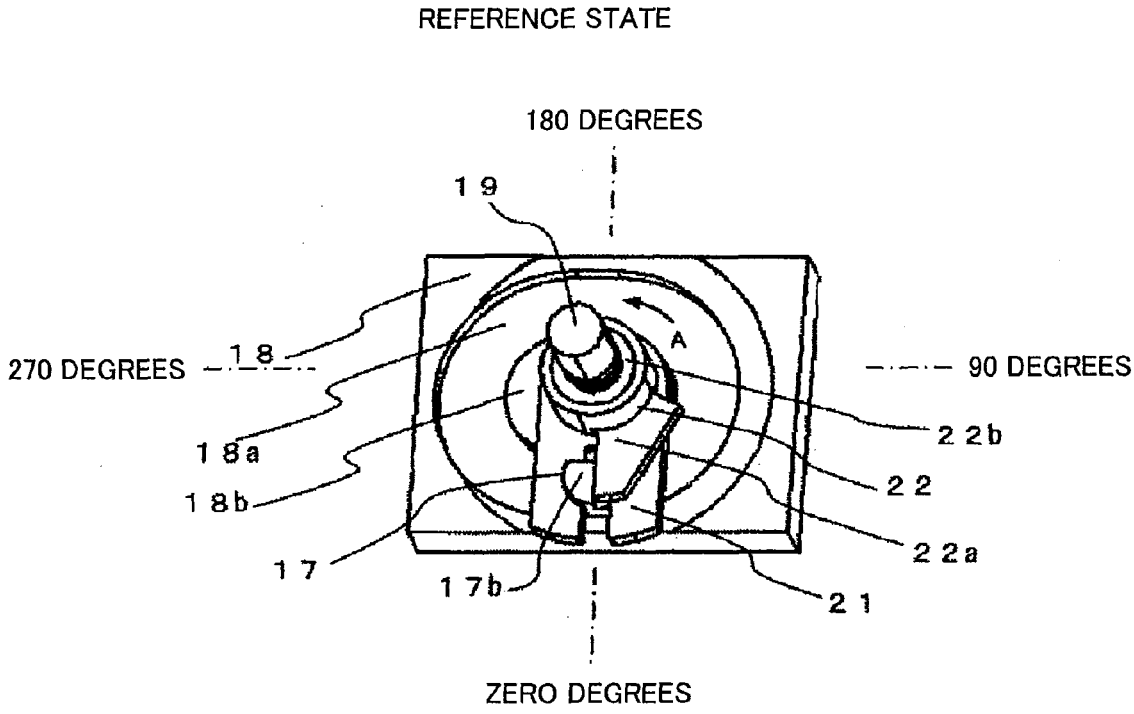
FIG. 7 is a perspective view of a reference state for the spring compression drive unit shown in FIG. 5.
Figure 8:
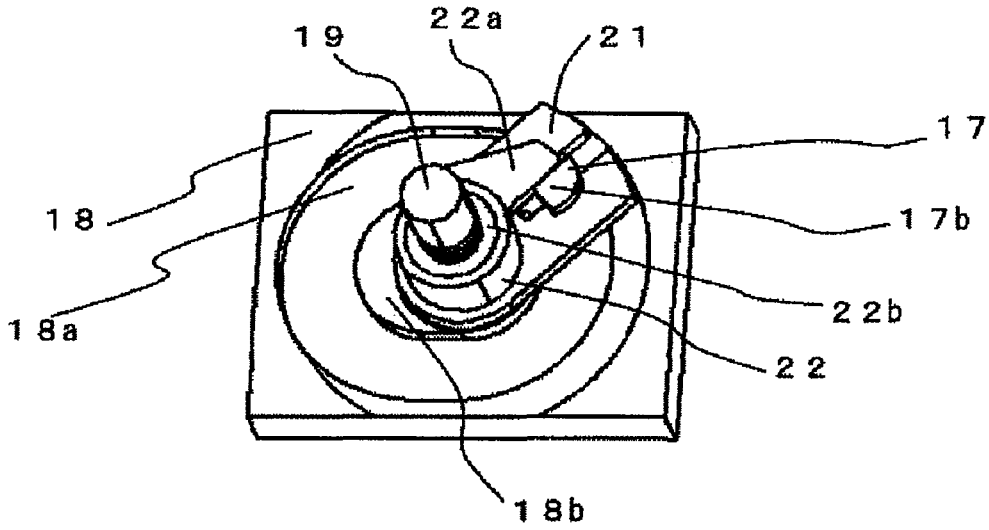
FIG. 8 is a perspective view showing the spring compression drive unit shown in FIG. 5 rotated through 135 degrees.
Figure 9:
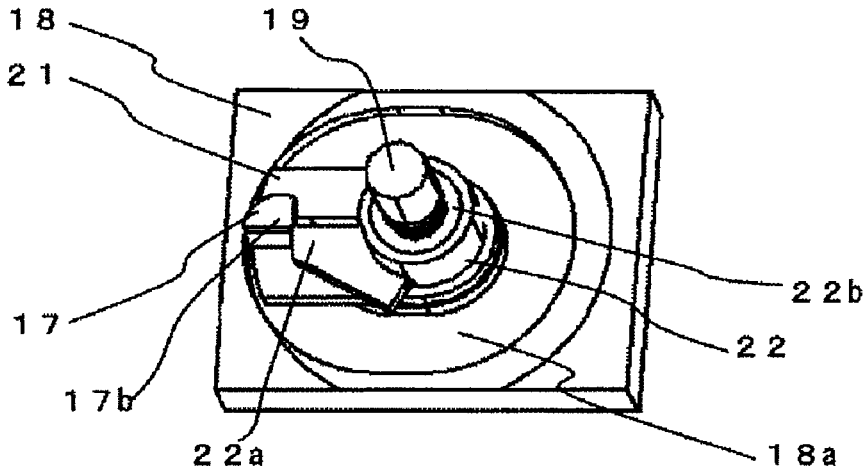
FIG. 9 is a perspective view showing the spring compression drive unit shown in FIG. 5 rotated through 270 degrees.
Figure 10:
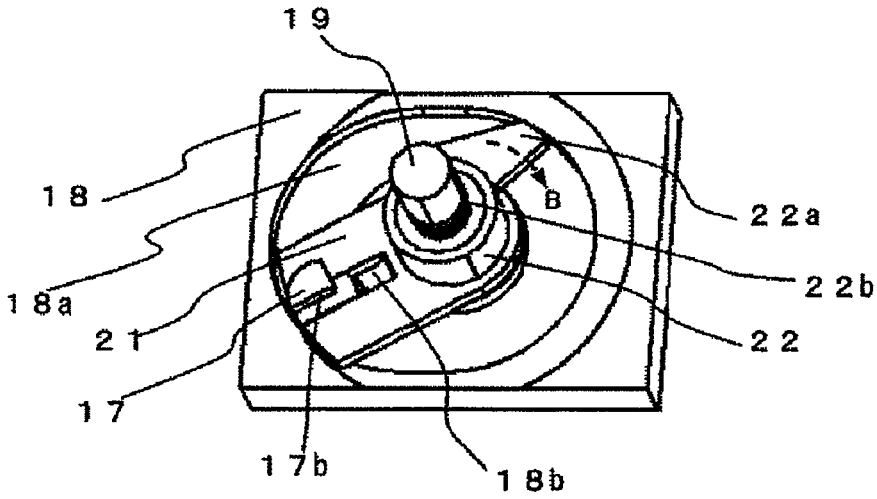
FIG. 10 is a perspective view showing the spring compression drive unit shown in FIG. 5 when rotated in reverse.

FIG. 7 shows the case where the hook section 22*a* (pin hooking section 17*b*) of the drum hook 22 is in a reference state at a position where the rotation angle is zero degrees. In this reference state, the plunger 8 is stopped at the lower dead point. FIG. 8 shows the situation when the hook section 22*a* (pin hooking section 17*b*) is rotated through approximately 135 degrees in the forward rotation direction A. FIG. 9 shows the situation when the hook section 22*a* (pin hooking section 17*b*) is rotated through approximately 270 degrees in the forward rotation direction A. FIG. 10 shows the situation where the hook section 22*a* is released from engagement with the pin hooking section 17*b* and the drum 13 is rotated in reverse in the reverse rotation direction B as a result of being urged by the spring 9 towards the plunger 8.

As a result of the above configuration, the plunger 8 urged by the spring 9 is pushed upwards to a prescribed position on the upper dead point side (drive start position) as a result of the action of the motor 7, the reduction mechanism unit 80, and the spring compression drive unit 81, while resisting the urging force (firing power) of the spring 9. The spring 9 compressed to the prescribed upper dead point position by the spring compression drive unit 81 is then released. The urging force (firing force) obtained at the time of release then acts on the blade 8*a* fitted to the plunger 8 so as to provide an impact force via the blade 8*a* to the nail 23 loaded in the magazine 6. The nail 23 can therefore be driven in the direction of the member to be fastened from the nose 5. Next, a detailed description is now given of the operation of the spring compression drive unit 81 with reference to FIGS. 7 to 10.

When the plunger 8 is in a reference state where the plunger 8 (refer to FIG. 1) is stopped at the lower dead point, the plunger 8 is pushed down to the lower dead point by the urging force of the spring 9. The pin hooking section 17*b* driven by the drum 13 that winds up the wire 16 is, for example, the reference position, as shown in FIG. 7. When an operator then grasps the handle housing unit 3 of the fastener driving tool 1, pulls back the trigger switch 10 so as to put the trigger switch 54 on, and presses the push switch 55 provided at the tip of the nose 5 against the member to be fastened, electrical power is supplied from the battery pack 4 to the motor 7 by the function of the controller 50 described later. The motor 7 (refer to FIGS. 2 and 3) then rotates in the forward rotation direction A. As shown in FIG. 3, the rotational force of the motor 7 is transmitted to the rotation output shaft 15*a* of the first reduction unit constituted by the first pulley 14 fitted to the rotation output shaft 7*a*, the second pulley 15, and the belt 40 wrapped across the first pulley 14 and the second pulley 15. The rotational force of the motor 7 is then transmitted to the rotation output shaft 19 by a second reducing unit constituted by the three stage planetary gear unit 11. The rotational force of the motor 7 is then transmitted to the pin support plate 21 which is mechanically engaged with the rotation output shaft 19 and the power transmission pin 17. At this time, the motor 7 rotates in the forward rotation direction A. The one-way clutch 24 therefore idles and rotation of the motor 7 in the forward rotation direction A is permitted.

As shown in FIG. 7, the power transmission pin 17 and the hook section 22*a* are in engagement in the reference state of the spring compression drive unit 81. The pin support plate 21 therefore receives the rotational force of the motor 7 so as to rotate, and the drum hook 22 and the drum 13 rotate in the forward rotation direction A. The drum 13 then winds up the wire 16 onto the drum groove 13*b* provided at the outer surface of the drum 13 during rotation of the drum 13 in the forward rotation direction A. When the wire 16 is wound onto the drum 13 in the direction A, the plunger 8 coupled to the end of the wire 16 is pushed upwards towards the upper dead point side against the urging force of the spring 9. The plunger 8 moves towards the upper dead point side and the spring 9 is compressed by the plunger plate 8*b* provided at the upper end surface of the plunger 8.

FIG. 8 shows the situation when the hook section 22*a* is rotated through approximately 135 degrees from the reference position shown in FIG. 7. The drum 13 is also rotated through approximately 135 degrees in synchronism with the rotation of the pin support plate 21, the wire 16 is wound up, and the spring 9 is compressed. A side end of the power transmission pin 17 comes into contact with a guide projection 18*b* that defines an inner wall section of the guide channel 18*a* in accordance with the pin support plate 21 being rotated from this state of being rotated through 135 degrees as shown in FIG. 8 to a state of being rotated through approximately 270 degrees as shown in FIG. 9 as a result of the rotation of the motor 7. The guide projection 18*b* is substantially elliptical in shape with a planar shape that bulges by approximately 5 to 15 millimeters in a radial direction from the center of its axis of rotation. As the pin support plate 21 rotates, the power transmission pin 17 moves in a radial direction along the external shape of the guide projection 18*b* so as to become more distant than the rotation output shaft 19.

When the pin support plate 21 enters a state of rotation of approximately 270 degrees (FIG. 9) from the reference state in FIG. 7, the power transmission pin 17 moves approximately 5 to 15 millimeters in the radial direction. The connection (engagement) between the power transmission pin 17 and the hook section 22*a* is therefore released. As shown in FIG. 9, when the drum 13 is rotated through approximately 270 degrees from the initial state, the plunger 8 is lifted as far as a maximum position (refer to FIG. 13H) on the upper dead point side by the wire 16 and the spring 9 also enters a state of maximum compression.

When the connection between the power transmission pin 17 and the hook section 22*a* is released in a state of rotation through approximately 270 degrees as shown in FIG. 9, the compressed spring 9 is released, and the plunger 8 moves towards the lower dead point side due to the force released from the spring 9 (firing force). As shown in FIG. 10, when the plunger 8 moves to the lower dead point side, the drum 13 and the drum hook 22 are pulled by the wire 16 and rotation in the opposite direction B to the forward rotation direction A of the rotation output shaft 19 commences.

When the drum 13 is rotated in reverse in the direction B by the force released from the compressed spring 9 so that the plunger 8 reaches the lower dead point, the blade 8*a* fitted to the end of the plunger 8 passes through the ejection section path 5*a* of the nose 5 and therefore drives the nail 23 towards the member to be fastened. When the drum 13 returns to the reference state at the same time as the driving, a drum damper engaging section 13*a* of the drum 13 engages with the drum damper 13*c* shown in FIG. 2. The drum 13 and the drum hook 22 then reengage at the reference position as shown in FIG. 7.

As described in the following, even after the nail 23 is driven in, the motor 7 is driven for a prescribed time by the controller 50. The drum 13 is therefore made to rotate in the forward rotation direction A again as a result of the reengagement of the power transmission pin 17 and the hook section 22*a*. The drum 13 winds up the wire 16 so as to move the plunger 8 as far as a prescribed position. The spring 9 is therefore compressed so as to have a prescribed urging force. According to this embodiment, when the rotation angle of the drum 13 is rotated as far as approximately 200 degrees, the stop switch (operation detection switch) 56 operates and operation of the motor 7 is stopped. The one-way clutch 24 (refer to FIG. 3) is therefore prevented from rotating in the reverse rotation direction B. The final rotation of the drum 13 in the driving cycle is stopped in a position at approximately 200 degrees so as to enter the initial state for the next drive cycle.

The timing of stopping the motor 7 is after the operation detection switch 56 (refer to FIG. 3) detects a prescribed rotation angle for the drum 13 occurring in the forward rotation direction. Even if the motor 7 is stopped at this timing, the drum 13 continues to rotate as a result of the rotation inertia of the rotor (not shown) of the motor 7, the planetary gear unit 11, and the rotation output shaft 19 and the drum 13 therefore rotates as described above. The plunger 8 is therefore pushed up and stopping takes place while the spring 9 is further compressed.

[Circuit Configuration for the Controller 50]

Figure 11:
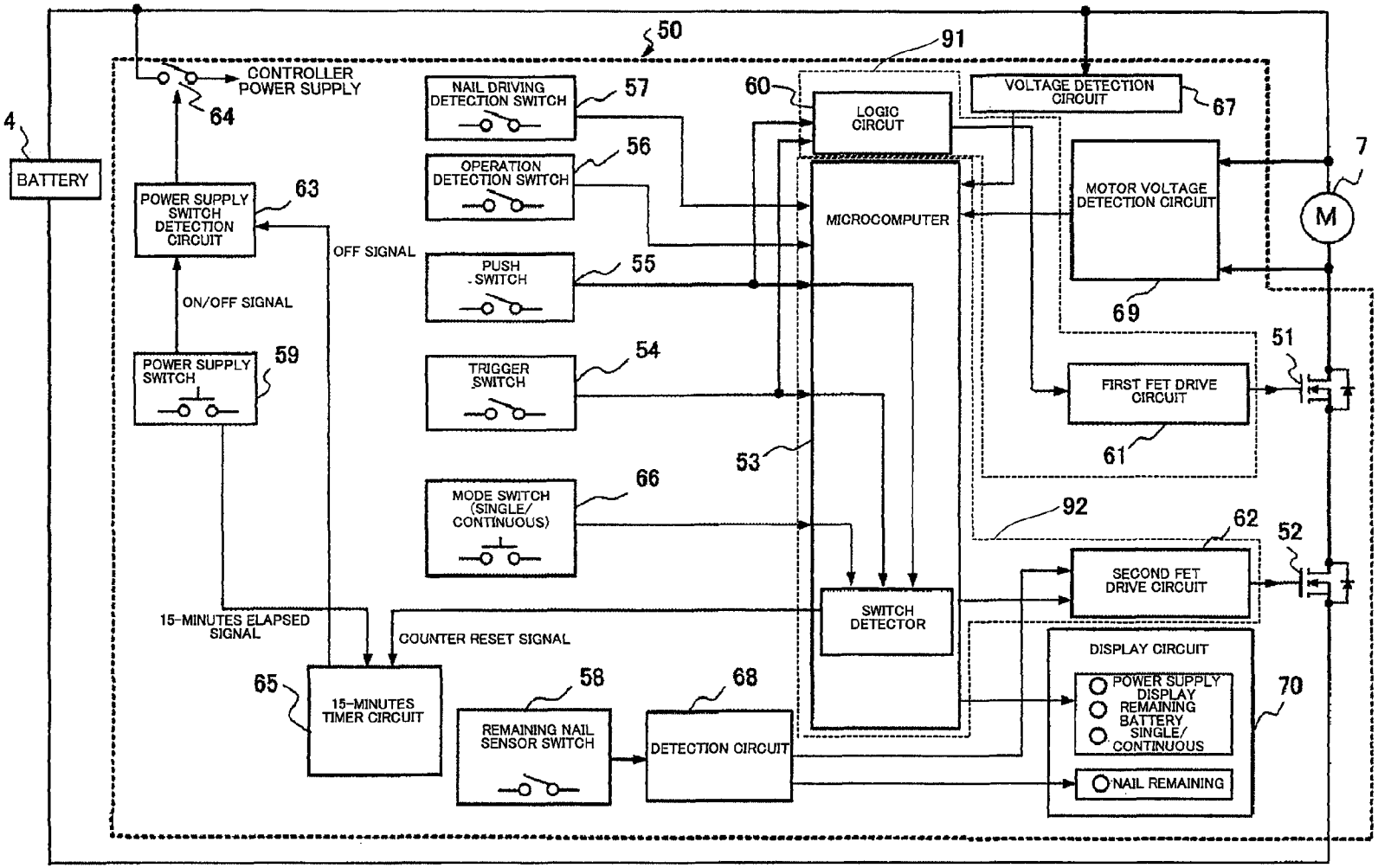
FIG. 11 is a block diagram of a controller used by the fastener driving tool shown in FIG. 1.

Next, an explanation is given with reference to FIG. 11 of a circuit configuration for the controller 50.

A battery of the battery pack 4 is, for example, a lithium ion secondary battery that is a power supply Vcc supplying electrical power to the motor 7 (for example, a DC. motor) and the controller 50. A first semiconductor switching element (first switching element) 51 and a second semiconductor switching element (second switching element) 52 connected together in series are connected across the motor 7 and the battery pack 4. For example, an N-channel insulating gate-type FET is applicable as the semiconductor switching elements 51 and 52. In the following explanation, the first semiconductor switching element 51 and the second semiconductor switching element 52 are respectively described as a first FET 51 and a second FET 52. This means that is it possible to prevent nails being carelessly driven in even when the conductive state of either one of the semiconductor switching elements fails as a result of becoming thermally damaged because a pair of the first FET 51 and the second FET 52 are connected in series. This gives a high level of reliability because of the high-level of redundancy. A power supply switch 64 of the controller 50 is controlled to go on and off by the output of a power supply switch detection circuit 63 that detects the operation of a power supply switch 59 and supplies or ceases the supply of power to the controller 50.

The controller 50 includes a first FET drive circuit 61 for driving the first FET 51 and a second FET drive circuit 62 for driving the second FET 52, a motor voltage detection circuit 69 that detects the rotational speed of the motor 7 as electromotive force of the motor, and a display circuit 70 that displays the throwing on of the power supply, the amount of battery remaining, single/continuous mode, and nails remaining. The controller 50 includes a logic circuit 60 for forming a control signal for the first FET drive circuit 61, a remaining nails sensor switch 58, provided at the tip of the nose 5 of the magazine 6 so as to engage with the feeding member 6*a*, that detects the quantity of continuous nails 23 (for example, 0 to 5) loaded in the magazine 6, a detection circuit 68 that detects the output of the remaining nails sensor switch 58, and a 15-minute timer circuit 65 that counts whether or not a prescribed time has elapsed (for example, 15 minutes) from the power supply switch 59 going on.

The controller 50 includes a microcomputer 53. A signal inputted as a control signal for the microcomputer 53 is a signal that is respectively outputted from a voltage detection circuit 67 that detects the voltage of the battery pack 4, the trigger switch 54 that detects a pulling operation of the trigger 10, the push switch 55 that detects whether or not the nose 5 is pushing the member to be fastened, the operation detection switch (stop switch) 56 that detects whether or not the rotation of the drum 13 has been restored to a prescribed angle after driving in the nail, a nail driving detection switch 57 that detects whether rotation of the drum 13 in the forward rotation direction A has rotated as far as a nail driving rotation angle (for example, 270 degrees), and a mode switch 66 that selects a nail driving mode to be single or continuous. The operation detection switch 56 is provided for stopping operation of the motor 7 so that the plunger 8 is made to stop at an appropriate upper dead point side position in resistance to the urging force of the spring 9.

The microcomputer 53 outputs the control signal to the second FET drive circuit 62 based on input signals of the various operation switches and detection circuits, and outputs various display signals to the display circuit 70 while simultaneously carrying out appropriate rotation control of the motor 7. When there is an input signal from the trigger switch 54, the push switch 55, and the mode switch 66, the microcomputer 53 outputs a count reset signal to the 15-minute timer circuit 65. When the controller power supply is turned on as a result of an on operation of the power supply switch 64, the 15-minute timer circuit 65 automatically starts to count. When 15-minutes elapses, the 15-minute timer circuit 65 outputs a signal for putting the controller power supply switch 64 to the power supply switch detection circuit 63 and cuts the power supply of the controller 50.

On the other hand, the remaining nails sensor switch 58 that detects the low quantity of nails remaining within the magazine 6 is connected to the detection circuit 68, and the output signal of the detection circuit 68 is inputted to the second FET drive circuit 62 and the display circuit 70. When the quantity of nails remaining is low, the second FET drive circuit 62 exerts control so that the second FET 52 does not go on in order to prevent the nails from running out and causing empty driving in advance and the display circuit 70 displays that the quantity of nails is low.

The logic circuit 60 and the first FET drive circuit 61 form a first control system circuit 91. The first control system circuit 91 controls the first FET 51 to go on or off based on an input signal from the trigger switch 54 and the push switch 55. The microcomputer 53 and the second FET drive circuit 62 form a second control system circuit 92 that controls the second FET 52. The time for which the first FET 51 is controlled to be in an ON state by the first control system circuit 91 is set to be longer than the time that the second FET 52 is controlled to be in an on state by the second control system circuit 92.

[An Example Circuit for the First Control System Circuit 91]

Figure 12:
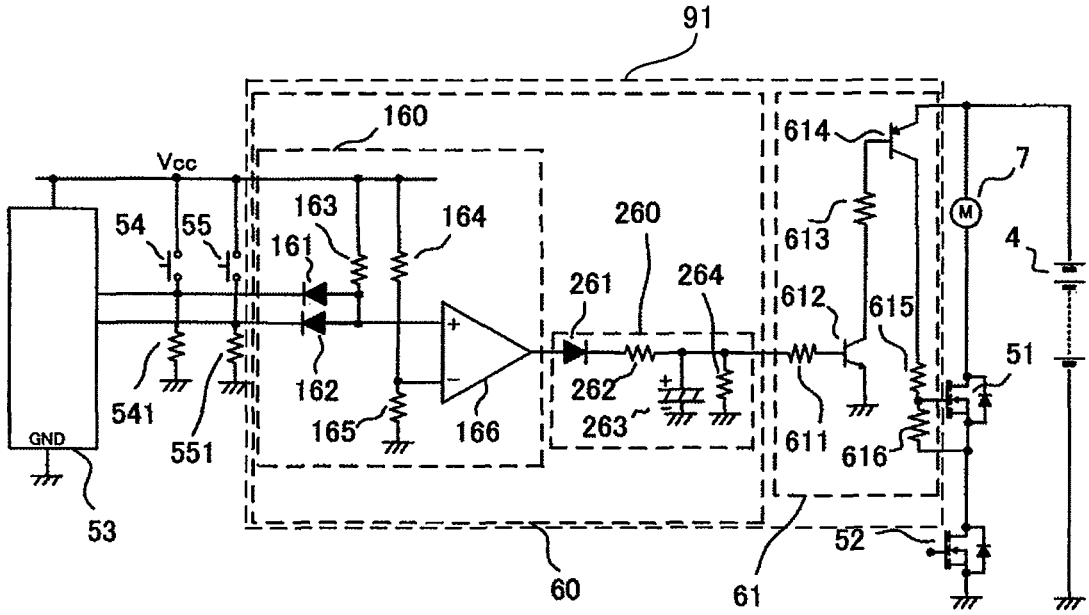
FIG. 12 is a circuit diagram showing an example of a logic circuit used in the controller shown in FIG. 1.

A specific example circuit for the first control system circuit 91 formed by the logic circuit 60 and the first FET drive circuit 61 is shown in FIG. 12. In FIG. 12, the second FET drive circuit 62 that controls the second FET 52 and other circuits are not shown.

As shown in FIG. 12, the logic circuit 60 includes an AND logic circuit 160 and an off delay circuit 260. The trigger switch 54 and the push switch 55 constitute an input unit of the logic circuit 60. One end of the trigger switch 54 and the push switch 55 is connected to a controller power supply Vcc and the other end is connected to ground via resistors 541 and 551. A connection point of the resistor 541 and the trigger switch 54 is connected to the microcomputer 53 and a cathode of the diode 161 and goes to a power supply potential Vcc or a ground potential in response to the trigger switch 54 going on or off. The microcomputer 53 is capable of detecting the operation of the trigger switch 54. An anode of the diode 161 is connected to the power supply Vcc via a resistor 163, and is also connected to a non-inverting input terminal (+) of an operational amplifier 166 and an anode of a diode 162. A resistance of the resistor 163 is set to be large compared to the resistor 541 (approximately ten times the resistance of the resistor 541). When the trigger switch 54 is off, a voltage of a tenth or less of the power supply voltage Vcc is applied to the terminals of the microcomputer 53. The microcomputer 53 is therefore capable of recognizing when the trigger switch 54 is on. The voltage Vcc is applied to the input terminal of the microcomputer 53 when the trigger switch 54 is on. The microcomputer 53 is therefore capable of recognizing when the trigger switch 54 is on. An input circuit formed from the push switch 55, the resistor 551, and the diode 162 operates in the same way as the input circuit for the trigger switch 54.

The inverting input terminal (−) of the operational amplifier 166 is connected to the power supply voltage Vcc via a resistor 164 and is connected to ground via a resistor 165. A voltage for the voltage dividing ratio of the resistor 164 and the resistor 165 for the voltage Vcc is applied to the non-inverting input terminal (−) of the operational amplifier 166 and a divided voltage is set to a substantially intermediate voltage for the power supply voltage Vcc. This means that when one of either the trigger switch 54 or the push switch 55 is off, a current flows to ground via one of the resistor 541 or the resistor 551 or via both resistors to ground. A smaller voltage than for the inverting input terminal (−) is then applied to the non-inverting input terminal (+) of the operational amplifier 166 and the operational amplifier 166 therefore outputs a low (Low) level.

Conversely, when the trigger switch 54 and the push switch 55 are both on, the cathode terminals of the diode 161 and the diode 162 are the power supply voltage Vcc. This means that the diodes 161 and 162 are both biased to a non-conducting state. As a result, an input voltage near to the power supply voltage Vcc is applied to the non-inverting input terminal (+) of the operational amplifier 166 via the resistor 163 and the operational amplifier 166 therefore outputs a high (High) level. The AND logic circuit 160 therefore outputs the AND of the switch state of the trigger switch 54 and the push switch 55.

The off delay circuit 260 includes an input diode 261, a charging resistor 262, a capacitor 263 for accumulating an output voltage for a high-level of the AND logic circuit 160, and a discharge resistor 264. A time constant for the charging resistor 262 and the capacitor 263 is set to be small compared to the time constant for the discharge resistor 264 and the capacitor 263.

When the AND logic circuit 160 outputs a high-level voltage, the capacitor 263 is charged comparatively quickly via the diode 261 and the charging resistor 262, and the off delay circuit 260 outputs a high-level output voltage. It is preferable for the delay time at this time to be made as short as possible. For example, in the order of 10 milliseconds to 50 milliseconds is appropriate. On the other hand, when the AND logic circuit 160 outputs a low level voltage, the charge of the capacitor 263 is discharged via the resistor 264. However, as described above, the discharge time constant for the capacitor 263 is large so the delay time therefore becomes long. This delay time is preferably set to 1 s or less, and in particular is preferably set in a range, from 100 milliseconds to 500 milliseconds. This delay time is set to a time longer than the spring compression time for after driving in described later.

The first FET drive circuit 61 includes a PNP transistor 614 and an NPN transistor 612. Voltage dividing resistors 615 and 616 are connected to the gate (control electrode) of the first FET 51 so as to form a load resistor for the transistor 614. When the transistor 614 is on, the first FET 51 goes on. A collector of the NPN transistor 612 is connected to the base of the transistor 614 via a base current limiting resistor 613. The base of the NPN transistor 612 is connected to the output of the off delay circuit 260 via the base current limiting resistor 613. The emitter of the transistor 612 is connected to ground. With this circuit configuration, when the logic circuit 60 outputs a high-level voltage, the NPN transistor 612 and the PNP transistor 614 go on and the first FET 51 also goes on.

The first control system circuit 91 constituted by the logic circuit 60 and the first FET drive circuit 61 has the off delay circuit 260. This means that the first FET 51 remains on for the prescribed time Th (refer to FIG. 13) without the first FET 51 going off immediately even if one of the trigger switch 54 or the push switch 55 (in this embodiment, the push switch 55) is turned off. The first FET 51 therefore remains on within the prescribed time Th after the nail is driven in. This means that the motor 7 is driven, and the plunger 8 moves to the prescribed position before driving nails while the drive spring 9 is compressed.

[Operation of the Controller 50]

When the fastener driving tool 1 is used, the operator first selects single mode (single driving mode) or continuous mode (continuous driving mode) using the mode switch 66. In this embodiment, in the case of single mode, the operator first pushes the push switch 55 towards the member to be fastened so as to put the push switch 55 on. Next, when the trigger 10 is pulled so that the trigger switch 54 is put on, one nail can be driven in simultaneously with the trigger switch 54 going on. After this, when the second nail is driven in, the operator first temporarily releases the operation of both the push switch 55 and the trigger 10 so as to put both the push switch 55 and the trigger switch 54 off. It is then necessary for the operator to repeat the push operation of the push switch 55 and the on operation of the trigger switch 54.

On the other hand, when the continuous mode is selected, the operator first pulls the trigger 10 so as to put the trigger switch 54 on, and then intermittently pushes the push switch 55 against the member to be fastened while keeping the trigger switch 54 on. As a result of this operation, the operator can continuously drive in nails. In the operation in continuous mode, both a so-called "slow operation continuous mode" where the time for which the push switch 55 is on becomes comparatively long while the push switch 55 is intermittently pushed towards the member to be fastened, and conversely, a so-called "fast operation continuous mode" where the time for which the push switch 55 is on is comparatively short exist. If the present invention is applied, substantial effects can be obtained, particularly for the case of fast operation continuous mode. "Fast operation continuous mode" and "slow operation continuous mode" are described in the following.

(Slow Operation Continuous Mode)

The timing diagrams of FIGS. 13A to 13H show the operation for the case where the on time for the push switch 55 is comparatively long in continuous mode operation.

Figures 13A, 13B, 13C, 13D, 13E, 13F, 13G, 13H:
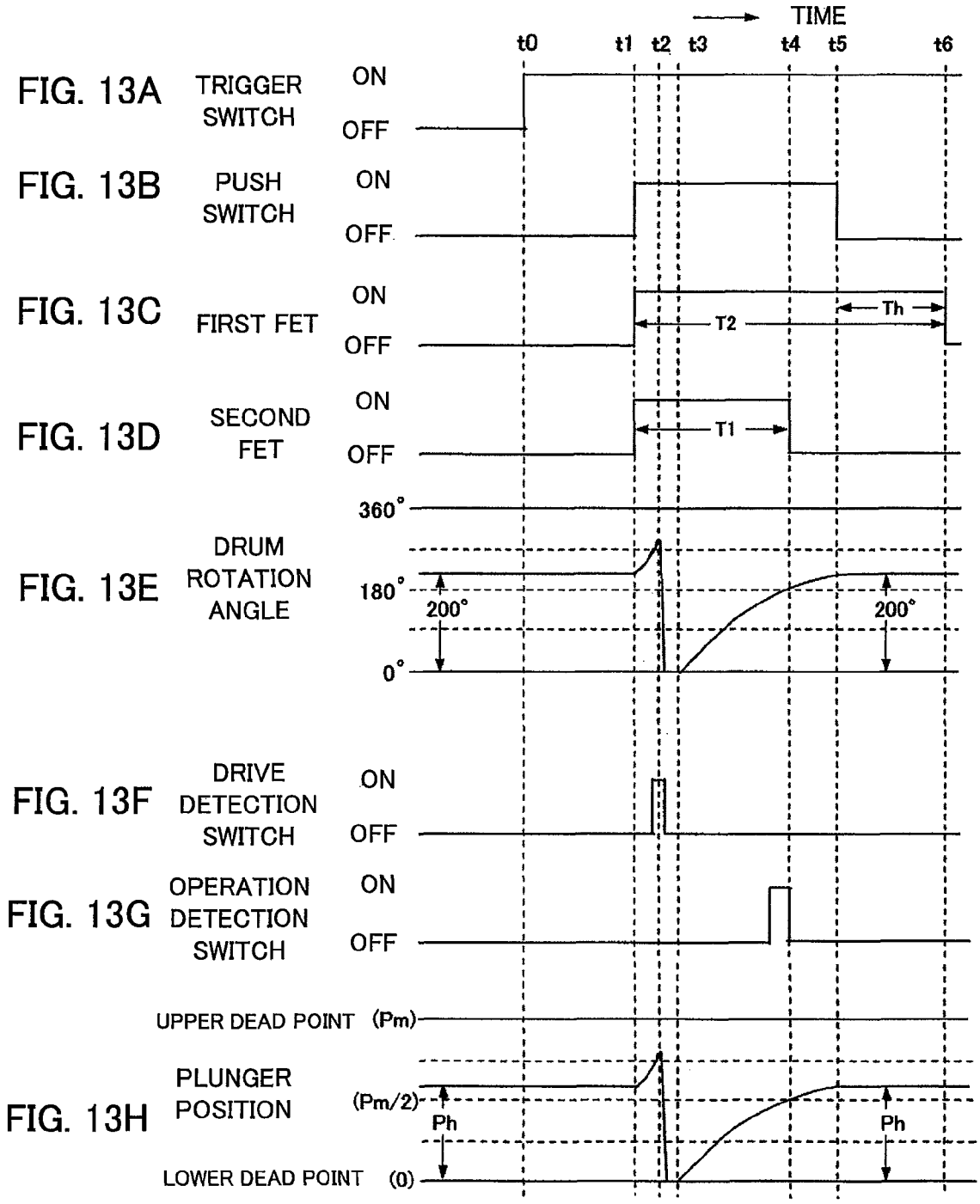
FIGS. 13A to 13H are timing diagrams for slow operation occurring in continuous driving in mode for the fastener driving tool of the embodiment of the present invention.

In the initial state before driving (before time t0), as shown in FIG. 13E, the drum 13 of the spring compression drive unit 81 is stopped at a rotation angle of approximately 200 degrees from the reference state (state of zero degrees) shown in FIG. 7. First, at the time t0, the trigger switch 54 goes on. Next, at a time t1, when the push switch 55 goes on, the input of the AND logic circuit 160 puts the trigger switch 54 and the push switch 55 both on and the AND logic circuit 160 outputs a high level output voltage. The output of the AND logic circuit 160 is then delayed by the off delay circuit 260 and the output of the logic circuit 60 is changed to a high-level output voltage. As a result, the transistors 612 and 614 of the first FET drive circuit 61 both go on and the first FET 51 also goes on.

On the other hand, the microcomputer 53 constituting the second control system circuit also detects that the trigger switch 54 and the push switch 55 are on, and puts the second FET 52 on via the second FET drive circuit. Then the first FET 51 and the second FET 52 are both switched on at a time t1. The motor 7 is therefore supplied with electrical power by the battery pack 4 and rotation commences. When the motor 7 rotates, the drive power of the motor 7 is transmitted to the drum 13 of the spring compression drive unit 81 via the reduction mechanism unit 80. The drum 13 rotates in the forward rotation direction A so as to wind up the wire 16, the plunger 8 is pulled up, and the spring 9 is compressed.

At time t1 to time t2, when the drum 13 rotates approximately 270 degrees from the reference state shown in FIG. 7, at the time t2, as shown in FIG. 9, engagement of the power transmission pin 17 and the hook section 22*a* is released. The drum 13 is therefore in a freely rotating state with respect to the rotation output shaft 19 without being subjected to the drive power of the motor 7. This is to say that the drum 13 is separated from the rotation output shaft 19 which the drive power of the motor 7 is transmitted to as a result of the clutch function of the spring compression drive unit 81.

As a result, at time t2 to time t3, the plunger 8 compressed by the spring 9 is released. The blade 8*a* of the plunger 8 then strikes the nail 23 as a result of the urging force of the spring 9 and the nail 23 is driven into the member to be fastened. At this time, the nail driving detection switch 57 is put on by the drum damper engaging section 13*a* (refer to FIG. 2) provided at the drum 13 at time t2 and the time of driving in the nail 23 is detected.

At the time t3 after driving in the nail, the power transmission pin 17 of the spring compression drive unit 81 is re-engaged with the hook section 22*a*, and the rotation output shaft 19 outputting the drive power of the motor 7 is mechanically coupled to the drum 13. At this time, the first FET 51 and the second FET 52 are both on. The operation of the motor 7 is therefore maintained, the drum 13 is rotated in the direction A that winds up the wire, and the spring 9 is compressed again.

At time t3 to time t4, when the drum 13 is rotated from the reference state to the vicinity of approximately 180 degrees and the drive spring 9 is compressed, in the vicinity of the time t4, the operation detection switch (stop switch) 56 goes on for a prescribed time. This is to say that the operation detection switch 56 goes on when the rotation angle of the drum 13 in the forward rotation direction A is rotated to the vicinity of 180 degrees. At time t4, the detection signal of the operation detection switch 56 is inputted to the microcomputer 53. The microcomputer 53 then puts the second FET 52 off via the second FET drive circuit 62 based on the detection signal of the operation detection switch 56 and excitation of the motor 7 is stopped.

Even if excitation of the motor 7 is stopped at the time t4, at time t4 to time t5, as shown in FIG. 13E, the drum 13 continues to rotate as a result of the rotational inertia of the spring compression drive unit 81 and the reduction mechanism unit 80 including the drum 13 and the spring 9 is further compressed. At time t5, when the rotational speed of the drum 13 becomes 0, it is taken that attempts are being made to rotate the drum 13 in the reverse rotation direction B due to the urging force of the spring 9. However, reverse rotation of the drum 13 is stopped by the function of the one-way clutch 24, and the drum 13 is stopped and held in a state where the plunger 8 is pulled via the wire 16. The rotation angle of the drum 13 in this stationary state then becomes approximately 200 degrees and the rotation angle of the initial state is then returned to.

When the push switch 55 is put off at the time t5, the logic circuit 60 puts the first FET off at the time t6 after a prescribed time Th (refer to FIG. 13C) defined by the delay function of the off delay circuit 260 elapses. In this event, the time t5 where the push switch 55 is returned to being off is a time later than the time t4 where the second FET 52 is put off and is therefore after the end of the winding operation by the drum 13. Namely, the time that the push switch 55 goes on (time t1 to time t5) is longer than the on time T1 for the second FET 52.

As is clear from the above operation, the off delay circuit 260 constituting the logic circuit 60 (first control system circuit) ensures that the first FET 51 does not go off immediately even if the push switch 55 goes off. Namely, the off delay circuit 260 keeps the first FET 51 on for a prescribed time Th after the push switch 55 goes off. As a result, even if the push switch 55 goes off before the time where the second FET 52 goes off, the time T2 (refer to FIG. 13C) where the first FET 51 is on for becomes longer than the time T1 (refer to FIG. 13D) where the second FET 52 is on for. It is therefore possible to supply electrical power to the motor 7 for a prescribed time (T1) and controlling of the position (height) of the initial state of the plunger 8 to a position Ph ½ or greater than the maximum position Pm is straightforward, as shown in FIG. 13. In particular, the function where the first control system circuit 91 (logic circuit 60 and the first FET drive circuit 61) maintains an on state for a prescribed time Th brings about beneficial effects when driving in "fast operation continuous mode" where the on time of the push switch 55 is shorter than the on time of the second FET 52 as described below.

(Fast Operation Continuous Mode)

FIGS. 14A to 14H are timing diagrams showing the fast operation continuous mode. The operation occurring from time t10 to time t16 is the same as the operation described with reference to FIGS. 13A to 13H. Namely, time t10 to t16 can be described as corresponding to time t0 to t6 of FIGS. 13A to 13H. In the timing diagram of FIGS. 14A to 14H, the push switch 55 is off at the time t14. Namely, the push switch 55 is returned to being off before the time t15 where the second FET 52 goes off and the on time (t11 to t14) of the push switch 55 is then shorter than the on time T1 of the second FET 52.

In the continuous operation, the operator moves the nose 5 of the fastener driving tool 1 to the next location immediately after driving in order to drive in a large number of nails in a short time. This means that during the compression operation of the spring 9 directly after driving in the previous time, at time t14, there are cases where the operator takes the nose 5 away from the member to be fastened so as to cause the push switch 55 to go off. If the first FET 51 is put off immediately at the time t14 based on the push switch 55 going off, the supply of current to the motor 7 is stopped immediately. In this event, stopping takes place with the rotation angle of the drum 13 at 180 degrees or less and compression of the spring 9 is therefore insufficient. The result of this is that the driving in operation time occurring at the next consecutive driving in operation becomes long and the feeling deteriorates when driving in. According to the present invention, degradation of the feeling when driving in can be prevented.

This is to say that the first FET 51 is maintained (continued) on during the off delay time Th (refer to FIG. 14C) of the off delay circuit 260 even if the push switch 55 goes off at time t14, due to the function of the off delay circuit 260 at the logic circuit 60. The result of this is that the on time T2 of the first FET 51 can be controlled to be longer than the on time T1 (refer to FIG. 14D) of the second FET 52. The first FET 51 is also always on for the time T1 where the second FET is on. It is therefore possible to supply electrical power to the motor 7. As a result, as shown in FIG. 14E, the drum 13 is rotated to the angle of the initial state of approximately 200 degrees by the motor 7 and the position (height) of the initial state of the plunger 8 is controlled to be a position Ph that is ½ or more of the maximum position Pm.

Figures 14A, 14B, 14C, 14D, 14E, 14F, 14G, 14H:
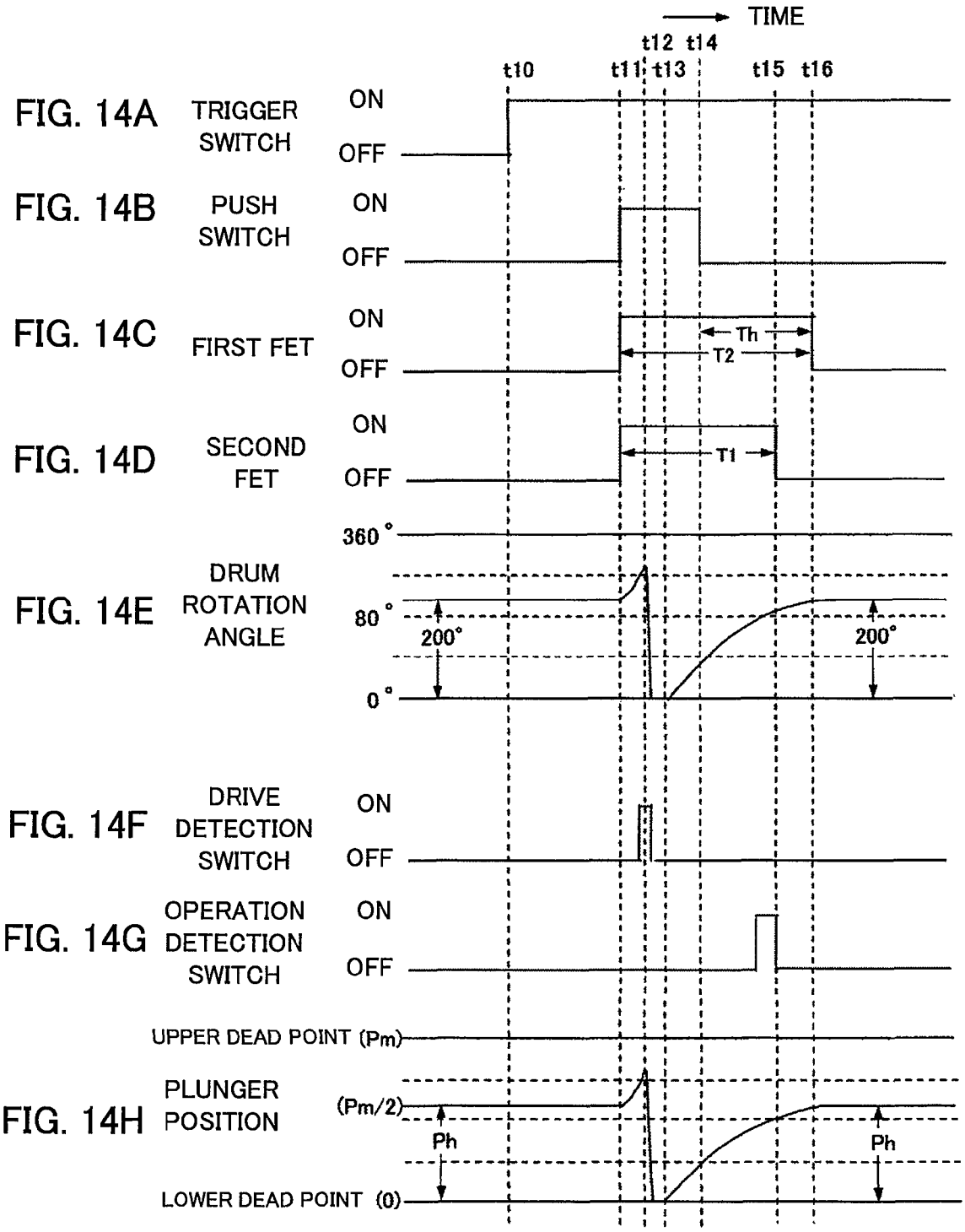
FIGS. 14A to 14H are timing diagrams for fast operation occurring in continuous driving in mode for the fastener driving tool of the embodiment of the present invention.

As shown in FIG. 14H, the spring 9 is compressed so as to have a prescribed compression force as a result of the plunger 8 being pulled out as far as the prescribed position Ph. As a result, it is therefore also possible to reduce the time required from the time t11 where the trigger switch 54 and the push switch 55 are detected and the nail driving operation commences until the time t12 where driving in of the nail is complete when driving in a nail at the next driving cycle and it is therefore also possible to improve the feeling when driving in.

According to the configuration for the present invention described above, it is possible to prevent erroneous operation of the motor 7 even in the unlikely event where one of the first FET 51 and the second FET 52 goes on as the result of a failure such as a common failure of a semiconductor element or as a result of thermal breakdown etc. and reliability can therefore be ensured.

It is also possible for an on failure of the trigger switch 54 and the push switch 55 that are operation switches or an on failure of the first FET 51 or the second FET 52 to be detected by a diagnosis function provided at the microcomputer 53. For example, the detection of failure of the trigger switch 54 or the push switch 55 can be achieved by detecting whether or not it is possible to reset to the initial conditions using a reset function of the microcomputer 53 for detecting this as a failure state if reset signal to the initial conditions is not possible, after the controller power supply of the microcomputer 53 is turned on.

The on failure of the first FET 51 and the second FET 52 can also be detected by, for example, providing a failure diagnosis routine. In this event, an on signal and an off signal are alternately inputted, one to the gate electrode of the first FET 51 and one to the gate electrode of the second FET 52. A series circuit voltage for the first FET 51 and the second FET 52 is detected as a high-level voltage or a low level voltage by the motor voltage detection circuit 69. If a low level drain voltage is detected, it is possible to detect that one FET is experiencing an on failure. In this event, it can be determined that the FET having the gate electrodes inputted with the off signal is experiencing an on failure. When a failure is detected for the reset routine or the failure diagnosis routine, it is possible to issue an abnormality notification by flashing a light for illuminating or displaying, or by emitting a buzzer sound based on the detection signal. It is also possible to inhibit a driving operation by the microcomputer 53 based on this detection signal.

As is clear from the above embodiment, according to the present invention, it is possible to maintain reliability of a stopped state of a fastener driving tool by using at least a pair of semiconductor switching elements for motor driving and a pair of control system circuit for controlling the switching elements and it is possible to reliably compress a spring so as to have a prescribed driving energy after the completion of driving in. It is therefore possible to make the spring compression time before driving in short. It is therefore possible to make the operation time from the operation of an operation switch such as a trigger switch or a push switch until the actual striking in of a nail short and it is possible to improve the feeling when driving in. In particular, according to the present invention, it is possible to provide a motor driven spring driven type fastener driving tool that is effective in the operation occurring at the time of a continuous mode where a large number of nails loaded in the magazine are driven in in a series of operations, that reduces time lag, and that produces superior feeling when driving in.

The above embodiment of the present invention is applied to trigger switches and push switches taken as operation switches but application to other operation switches is also possible. Further, a description is given of the case where the trigger switch is given priority over the push switch but it is also possible to give priority to operation of the push switch. Switches that are normally off are used as the trigger switches and the push switches but the present invention is also applicable to switches that are normally on.

A detailed description is given by the applicants based on the embodiment of the invention but the present invention is by no means limited to the above embodiment and various modifications are possible within the essential scope of the present invention.

Various embodiments and changes may be made thereunto without departing from the broad spirit and scope of the invention. The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. 2008-024832 filed on Feb. 5, 2008 and including specification, claims, drawings and summary. The disclosure of the above Japanese Patent Application is incorporated herein by reference in its entirety.

What is claimed is:

1. A fastener driving tool comprising:

a motor;

a magazine that supplies fasteners to a nose;

a plunger, arranged between an upper dead point and a lower dead point so as to be capable of moving up and down, having a blade for driving the fasteners supplied to the nose;

a drive spring that urges the plunger downwards, and that is capable of being compressed upwards;

a spring compression drive unit that moves the plunger in a direction of compression of the drive spring based on drive power of the motor;

a first operation switch that detects a first user operation;

a second operation switch that detects a second user operation;

an operation detection switch that detects operation of the spring compression drive unit;

a first switching element and a second switching element individually controlled to go on or off, electrically connected in series, and making supply of electrical power to the motor possible when both the first switching element and the second switching element are on;

a first controller including an AND logic circuit and a delay circuit to turn on the first switching element when both the first and second operation switches are turned on and to turn off the first switching element when a predetermined time period has lapsed after one of the first and second operation switches was turned off; and a second controller that turns on the second switching element when both the first and second operation switches are turned on and that turns off the second switching element when the operation detection switch generates a detection signal.

2. The fastener driving tool according to claim 1, wherein a time period that the first switching element maintains an on state is set to be longer than a time period that the second switching element maintains an on state.

3. The fastener driving tool according to claim 1, wherein the operation detection switch generates the detection signal when the plunger is moved in the direction of compression of the drive spring and reaches a predetermined position between the lower dead point and upper dead point.

4. The fastener driving tool according to claim 3, wherein the predetermined time period is set by means of the delay circuit based on a timing that the plunger reaches the predetermined position.

5. The fastener driving tool according to claim 1, wherein the predetermined time period is set to be within a range of 100 milliseconds to 500 milliseconds.

6. The fastener driving tool according to claim 1, wherein the first switching element and the second switching element respectively are field effect transistors.

7. The fastener driving tool according to claim 1, wherein:

the spring compression drive unit has a rotating body that rotates in a prescribed direction of rotation based on the drive power of the motor, and moves the plunger in a direction of compressing the drive spring by winding in a hoisting connecting line connected to the plunger using rotation of the rotating body in the prescribed rotation direction; and the operation detection switch detects a position of rotation of the rotating body.

8. The fastener driving tool according to claim 1, wherein:

the first operation switch is a trigger switch that detects an operation of pulling of the trigger pulled-in when the user performs a fastener driving in operation; and the second operation switch is a push switch that detects an operation where the user brings the nose into contact with a member to be fastened.

9. The fastener driving tool according to claim 1, wherein the spring compression drive unit comprises a rotating body that is driven by the motor in a prescribed rotation direction, wherein, within a first time duration, after the drive spring is compressed upwards by rotating the rotating body in the prescribed rotation direction, the compressed drive spring is released and extended downwards by disengaging the transmission of the drive power of the motor to the rotating body so that the fastener is driven into a target, and the drive spring is compressed again until the plunger moves upwards to a prescribed position as a result of the rotating body rotating in the prescribed rotation direction.

10. A fastener driving tool comprising:

a motor;

a magazine that supplies fasteners to a nose;

a plunger having a blade for driving the fasteners and configured to be movable between an upper dead point and a lower dead point;

a spring that urges the plunger downwards and is capable of being compressed upwards;

a rotating body that is driven by the motor;

a wire wound around the rotating body and connected to the plunger;

a transmission mechanism for transmitting drive power of the motor to the rotating body by way of an engagement/disengagement means;

a trigger switch that detects a first user operation and produces a first detection signal;

a push switch that detects a second user operation and produces a second detection signal;

a sensor that produces a third detection signal when the plunger reaches a predetermined position between the lower dead point and the upper dead point;

a first switching element and a second switching element connected in series with the motor and an electrical power source;

a first control unit for controlling the first switching element, the first control unit including a logic circuit that produces an output signal based on an AND logic of the first and second detection signals and a delay circuit for delaying the output signal of the logic circuit; and a second control unit that receives the first, second and third detection signals to control the second switching element, wherein the first switching element is turned on by the output signal of the logic circuit and is turned off by an output signal of the delay circuit, and wherein the second switching element is turned on when both the first and second detection signals are detected and is turned off when the third detection signal is detected.

* * * * *